US009788694B2

(12) United States Patent
Hill et al.

(10) Patent No.: US 9,788,694 B2
(45) Date of Patent: Oct. 17, 2017

(54) DISPENSING CONTAINER HAVING FLEXIBLE DISPENSING PARTITION

(71) Applicant: Kimberly-Clark Worldwide, Inc., Neenah, WI (US)

(72) Inventors: Robert M. Hill, Neenah, WI (US); Kevin Christopher Possell, Middleton, WI (US); Christopher Martin Pieper, Hortonville, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 40 days.

(21) Appl. No.: 14/231,111

(22) Filed: Mar. 31, 2014

(65) Prior Publication Data

US 2015/0272406 A1 Oct. 1, 2015

(51) Int. Cl.
*A47K 10/42* (2006.01)
*A47K 10/32* (2006.01)

(52) U.S. Cl.
CPC .... *A47K 10/421* (2013.01); *A47K 2010/3266* (2013.01)

(58) Field of Classification Search
CPC ..... A47K 10/24
See application file for complete search history.

(56) References Cited

U.S. PATENT DOCUMENTS 3,843,017 A 10/1974 Harrison
4,180,160 A * 12/1979 Ogawa ..... A47K 10/3818 206/210
4,353,480 A * 10/1982 McFadyen ..... A47K 10/3818 221/63
5,810,200 A 9/1998 Trokhan
6,412,656 B1 * 7/2002 Placik ..... A47K 10/421 221/33
6,673,358 B1 1/2004 Cole et al.
6,910,579 B2 6/2005 Reinke et al.
D531,897 S 11/2006 Evans et al.
(Continued)

FOREIGN PATENT DOCUMENTS

EP 0107487 A1 5/1984
EP 1401733 B1 3/2006
(Continued)

OTHER PUBLICATIONS

International Search Report and Written Opinion for International Application No. PCT/IS2015/051652, dated Jun. 23, 2015, 15 pages.

*Primary Examiner* — Timothy Waggoner
*Assistant Examiner* — Ayodeji Ojofeitimi
(74) *Attorney, Agent, or Firm* — Armstrong Teasdale LLP

(57) ABSTRACT

A dispensing container for dispensable wipes generally comprises a base at least partially defining an internal compartment for storing the wipes and a dispensing partition connected to the base. The dispensing partition comprises a flexible material having an aperture defined therein through which the wipes are individually removable. The dispensing partition is configured to move from a first position to a second position when one of the wipes is removed from the container through the aperture. The dispensing partition is biased towards the first position, and is at least partially inverted from the first position when in the second position.

21 Claims, 3 Drawing Sheets

(56) References Cited

U.S. PATENT DOCUMENTS

| | | | | |
|---|---|---|---|---|
| 7,216,775 | B2 | 5/2007 | Evans et al. | |
| 7,731,057 | B2 | 6/2010 | Evans et al. | |
| 8,245,876 | B2 | 8/2012 | Gehring et al. | |
| 2005/0236416 | A1* | 10/2005 | Reinke ..... | A47K 10/421 221/63 |
| 2009/0314793 | A1 | 12/2009 | Reedy et al. | |
| 2010/0206896 | A1 | 8/2010 | Ray et al. | |
| 2011/0011876 | A1 | 1/2011 | Baer | |
| 2011/0011878 | A1 | 1/2011 | Baer et al. | |
| 2012/0160864 | A1 | 6/2012 | Shoaf et al. | |

FOREIGN PATENT DOCUMENTS

| | | | |
|---|---|---|---|
| WO | 2005112556 | A2 | 12/2005 |
| WO | 2008025980 | A1 | 3/2008 |
| WO | 2013076467 | A2 | 5/2013 |

* cited by examiner

DISPENSING CONTAINER HAVING FLEXIBLE DISPENSING PARTITION

BACKGROUND

The present disclosure relates generally to dispensing containers for personal care products, and more particularly to dispensing containers having a flexible dispensing partition for dispensing sheeted personal care products.

There are a variety of storing and dispensing containers in the market, particularly those for storing and dispensing personal care products. Personal care products, particularly wipes, have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. Wet wipes have also been placed in containers in the form of a continuous web of material which includes perforations to separate the individual wet wipes and which is wound into a roll. Such wet wipes have been used for baby wipes, hand wipes, household cleaning wipes, industrial wipes and the like.

Conventional containers which contain wipes are typically plastic containers, tubs or soft-sided packages which provide a sealed environment for the wet wipes to ensure that they do not become dirty and/or overly dry. To access the wipes, many containers have an access lid that selectively closes an opening disposed on top of the container. The access lid can be manually moved from a closed position wherein the lid covers the opening to an opened position wherein the lid is spaced from the opening to thereby provide access to the opening.

Some of these conventional packages have been configured to provide one at a time dispensing of each wet wipe which can be accomplished using a single hand after the container has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a wet wipe to clean the infant. The care giver may not want to look away from the infant to open the container and access the wipes.

A wide variety of wet wipes dispensing containers are available in the market today. One type of dispensing container is known as a "pop-up" style dispensing container, which often includes a stack of flat interfolded wipes that are dispensed from a tub. The pop-up style containers have gained popularity because the wipes are more readily available to the user than other styles of dispensing containers (e.g., upright cylindrical containers). Although there is a greater opportunity for the wipes in a pop-up style container to at least partially dry out, improvements in container design have mitigated this problem.

However, conventional pop-up style containers are not completely satisfactory because they are often too bulky or unwieldy to be readily transportable. One reason that conventional pop-up style containers are too bulky is that a sufficient distance (also known as "head space") is needed between the stacked wipes and a dispensing aperture formed in a dispensing partition to allow the stacked wipes to properly unfold and exit the dispensing aperture without "jamming". Conventional dispensing partitions are typically static, and thus require that a minimum distance be maintained between the stack of wipes and the dispensing aperture to properly dispense wipes.

Additionally, when an access lid is utilized to provide a sealed environment for the wet wipes, the design of conventional dispensing partitions often causes the leading edge of a wipe (i.e., the edge of a wipe protruding out of a dispensing aperture) to prevent the access lid from completely closing or results in the wet wipe extending through the dispensing partition to be pushed back into the container such that no portion of the wipe is readily available for the user to grasp.

Accordingly, a need exists for a dispensing container having a flexible dispensing partition that facilitates reducing the overall size of the dispensing container, that allows the lid to easily close, and inhibits wipes extending through the dispensing partition from being pushed back into the container.

SUMMARY

In one aspect, a dispensing container for dispensable wipes is provided. The dispensing container comprises a base at least partially defining an internal compartment for storing the wipes and a dispensing partition connected to the base. The dispensing partition comprises a flexible material having an aperture defined therein through which the wipes are individually removable. The dispensing partition is configured to move from a first position to a second position when one of the wipes is removed from the container through the aperture. The dispensing partition is biased towards the first position, and is at least partially inverted from the first position when in the second position.

In another aspect, a dispensing partition for use with a dispensing container for storing and dispensing dispensable wipes is provided. The dispensing partition comprises a flexible material having an aperture defined therein through which the wipes are individually removable. The dispensing partition is configured to move from a first position to a second position when one of the wipes is removed from the container through the aperture. The dispensing partition is biased towards the first position, and is at least partially inverted from the first position when in the second position.

In yet another aspect, a dispensing container for dispensable wipes is provided. The dispensing container comprises a base at least partially defining an internal compartment for storing the wipes, and a dispensing partition connected to the base. The dispensing partition comprises a flexible material having an aperture defined therein through which the wipes are individually removable. The dispensing partition is connected to the base at a hinge, and extends downwardly into the compartment from a plane within which the hinge is disposed. The dispensing partition is invertible about the plane from a first position to a second position when a wipe is removed from the container through the aperture.

Other features of this disclosure will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
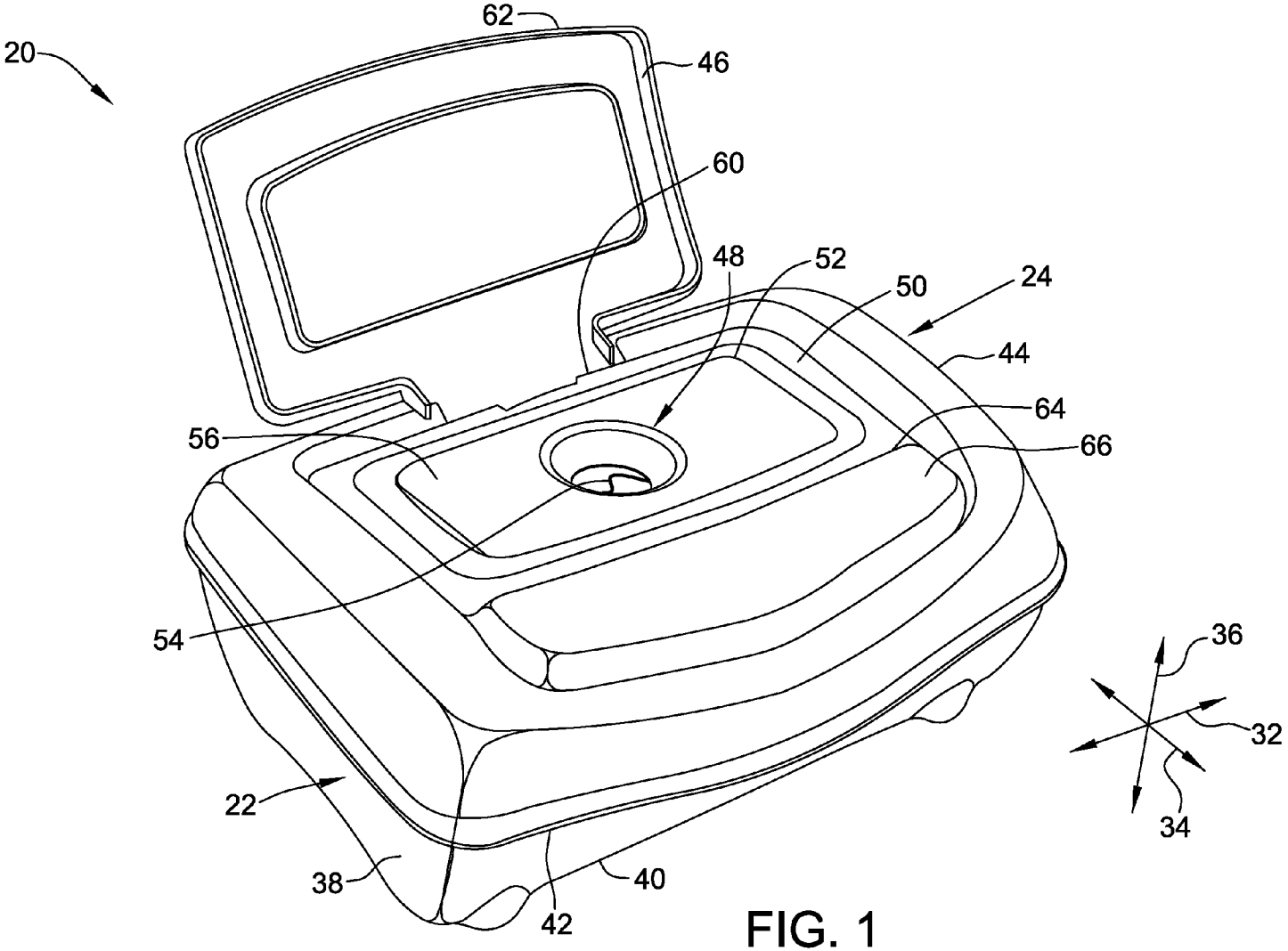
FIG. 1 is a perspective view of one suitable embodiment of a dispenser for personal care articles having a flexible dispensing partition.

The present disclosure is generally related to a refillable dispensing container that is configured to provide convenient carrying and ease of use, dispensing, and refilling. Specifically, the refillable dispensing container includes a flexible dispensing partition that is moveable between a first, non-dispensing position (also referred to as a non-dispensing state) and a second, dispensing position (also referred to as a dispensing state). The flexible dispensing partition facilitates reducing the overall size of the dispensing container. Further, in embodiments in which the dispensing container includes a lid, the flexible dispensing partition allows the lid to easily close, and inhibits wipes extending through the dispensing partition from being pushed back into the container.

One particularly suitable personal care product for which the container is suitable for storing are sheeted products such as wipes. Generally, the wipes stored in the containers of the present disclosure can be wet wipes, dry wipes, or anywhere in between. More specifically, suitable wipes for use in the present disclosure can include wet wipes, flushable moist wipes, hand wipes, face wipes, cosmetic wipes, household wipes, industrial wipes, baby wipes, facial tissues, toilet tissues, napkins, and the like. Particularly suitable wipes are wet wipes, baby wipes, and flushable moist wipes, and other wipe-types that include a wetting solution.

Materials suitable for the substrate of the wipes are well known to those skilled in the art, and are typically made from a fibrous sheet material which may be either woven or nonwoven. For example, suitable materials for use in the wipes may include nonwoven fibrous sheet materials which include meltblown, coform, air-laid, bonded-carded web materials, hydroentangled materials such as spunlace materials, and combinations thereof. Such materials can be comprised of synthetic or natural fibers, or a combination thereof.

As noted above, one particularly suitable personal care product is a wet wipe. The wetting solution in the wet wipe can be any wetting solution known to one skilled in the wet wipe art. Generally, the wetting solution can include water, emollients, surfactants, preservatives, chelating agents, pH adjusting agents, skin conditioners, fragrances, and combinations thereof. For example, one suitable wetting solution for use in the wet wipe stored in the dispensers of the present disclosure comprises about 98% (by weight) water, about 0.6% (by weight) surfactant, about 0.3% (by weight) humectant, about 0.3% (by weight) emulsifier, about 0.2% (by weight) chelating agent, about 0.35% (by weight) preservative, about 0.002% (by weight) skin conditioning agent, about 0.03% (by weight) fragrance, and about 0.07% (by weight) pH adjusting agent. One specific wetting solution suitable for use in the wet wipe is described in U.S. Pat. No. 6,673,358, issued to Cole et al. (Jan. 6, 2004), which is incorporated herein by reference to the extent it is consistent herewith.

Other personal care products that can be used in the dispenser of the present disclosure include, for example, tissue paper products such as facial tissue, toilet tissue, napkins, and the like.

In one embodiment, the container is made of a rigid or semi-rigid plastic material such as polyolefins, styrenics, or other semi-rigid plastics or any combinations thereof. By way of example, the rigid or semi-rigid plastic materials can include polypropylene, copolymer polypropylene, polystyrene, thermoplastic elastomers, combinations thereof, and various forms thereof. Further examples can include thermoplastic elastomers and other soft-touch resins as known in the art.

In another suitable embodiment, the container is made of a flexible non-woven or woven material. In such embodiments, the container may include a partially rigid or semi-rigid perimeter. Suitable flexible materials include, for example, meltblown, coform, air-laid, bonded-carded web materials, hydroentangled materials, and combinations and laminates thereof.

In another suitable embodiment, the container is made from at least one thin plastic flexible film material, such as a thermoplastic film made using a film extrusion and/or forming process. Suitable thermoplastic film materials for the container can include polyethylene, polypropylene, polystyrene, copolymer polypropylene or various other thermoformable-type materials or combinations thereof.

In one suitable embodiment, the dispensing partition is formed from a flexible, rubber-like material such as a thermoplastic elastomer (TPE). Suitable TPE's include, for example, styrenic-based TPE's (e.g., styrenic block copolymer compounds), styrenic-based TPE's containing rubber modifiers (e.g., Kraton™, Santoprene™, or other rubber modifiers), Kraton™, Santoprene™, specialty copolymers, such as ethylene-methyl acrylate copolymers (e.g., EMAC™ of the Eastman Chemical Company), thermoset rubbers, polyurethane, TPE alloys, amides, engineering TPE's, olefinic-based TPE'S, olefinic vulcanizates, polyester-based TPE's, polyurethane-based TPE's, and combinations thereof.

In one suitable embodiment, the dispensing partition is located on the outer surface of the container material and is disposed generally in the center of the container for dispensing the personal care products from the container. It should be understood that, while the dispensing partition is described herein as being located in the center of the container, the dispensing partition may be located in any position on the container suitable for removing (i.e., dispensing) the personal care product from the container.

In one suitable embodiment, such as when the personal care product contains moisture, such as a wet wipe, the dispensing partition can be sealed or covered using a rigid or semi-rigid plastic closing device or lid. For example, in one embodiment, the plastic closing device includes a lid top hingedly connected to the container, and male and female latching members that are releasably connectable to open and close the lid top.

Suitable rigid or semi-rigid plastic closing devices can include materials such as polyolefins, styrenics, or other semi-rigid plastics or any combinations thereof. By way of example, the rigid or semi-rigid plastic materials can include polypropylene, copolymer polypropylene, polystyrene, and various forms thereof. Further examples can include thermoplastic elastomers and other soft-touch resins as known in the art.

Typically, as noted above, the container has an internal compartment that holds the personal care products in a full, flat orientation. The personal care products can be removed, preferably in a single consistent manner, from the internal compartment of the container through the dispensing partition. The size of the container will depend upon the desired personal care product for which the container is to store. For example, in one embodiment, the container is designed to store baby wet wipes, which typically have a cross-sectional area of approximately 26.3 $in^2$ when in a full, flat orientation. As such, the container has a cross-sectional area of from approximately 26 $in^2$ to approximately 45 $in^2$.

Referring now to the drawings and in particular to FIG. 1, one suitable embodiment of a dispensing container for storing personal care products is generally indicated by the reference numeral 20.

The container 20 generally includes a base 22 and a lid assembly 24 connected to the base 22 at an upper end thereof. The base 22 and the lid assembly 24 collectively define an internal compartment 26 (shown in FIG. 2) within which a plurality of personal care products, illustrated as a stack 28 of interconnected wipes 30, are stored. The container 20 has a longitudinal axis 32 (also referred to herein as an x-direction), a lateral axis 34 (also referred to herein as a y-direction), and a vertical axis 36 (also referred to herein as a z-direction).

In the illustrated embodiment, the base 22 has a generally rectangular shape, and includes a sidewall 38 extending generally vertically from a bottom wall 40 to a top 42 of the base 22. It is contemplated that the base 22 may have any suitable shape that enables the container 20 to function as described herein, such as a polygonal shape, a circular shape, a rounded shape, an oblong shape, or suitable combinations thereof.

The base 22 may be constructed from a variety of suitable materials, including any of those materials described above as being suitable for the container 20. In the illustrated embodiment, the base 22 is constructed from a rigid or semi-rigid plastic material, such as polypropylene, copolymer polypropylene, polystyrene, thermoplastic elastomers, combinations thereof, and various forms thereof.

The lid assembly 24 is connected to the base 22 at the top 42 of the base 22, and includes a lid base 44, a lid top 46 hingedly connected to the lid base 44, and a flexible dispensing partition 48 connected to the lid base 44.

The lid base 44 is connected to the base 22 at the top 42 of the base 22, and is shaped complementary to the base 22. The lid base 44 may be connected to the base 22 so as to form a seal between the compartment 26 and an external environment to maintain a sufficient moisture level within the compartment 26.

The lid base 44 may be constructed from a variety of suitable materials, including any of those materials described above as being suitable for the container 20. The lid base 44 may be constructed from the same materials as the base 22, or the lid base 44 may be constructed from different materials than those used for the base 22. In the illustrated embodiment, the lid base 44 is constructed from the same materials as the base 22. In another suitable embodiment, the lid base 44 may be formed integrally with the base 22.

In the illustrated embodiment, the lid base 44 includes a port 50 to which the dispensing partition 48 is connected. The port 50 defines an opening 52 in the lid base 44 within which the dispensing partition 48 is received. The port 50 provides a generally rigid or semi-rigid support for the dispensing partition 48, and allows the dispensing partition 48 to deform when one of the wipes 30 is removed from the container 20 through the dispensing partition 48.

The dispensing partition 48 is formed from a flexible, rubber-like material, and includes a dispensing aperture 54 through which wipes 30 stored within the compartment may be removed. More specifically, the dispensing partition 48 is suitably flexible, yet suitably resilient such that the dispensing partition 48 deforms when one of the wipes 30 is removed from the container 20 through the dispensing aperture 54, and returns to its original shape after the wipe is removed from the dispensing partition 48. In one suitable embodiment, for example, the dispensing partition is constructed from a thermoplastic elastomer (TPE), such as styrenic-based TPE's (e.g., styrenic block copolymer compounds), styrenic-based TPE's containing rubber modifiers (e.g., Kraton™, Santoprene™, or other rubber modifiers), Kraton™, Santoprene™, specialty copolymers, such as ethylene-methyl acrylate copolymers (e.g., EMAC' of the Eastman Chemical Company), thermoset rubbers, polyurethane, TPE alloys, amides, engineering TPE's, olefinic-based TPE'S, olefinic vulcanizates, polyester-based TPE's, polyurethane-based TPE's, and combinations thereof.

In the illustrated embodiment, the dispensing partition 48 is formed from a single unitary or undivided section of material. Use of a unitary section of material provides improved moisture retention of the container 20 as compared to other known dispensing containers. For example, other non-flexible materials, such as rigid plastics, used to provide similar arrangements are typically connected together using mechanical means. This creates larger spaces in and around the dispensing aperture, which allows moisture to evaporate into the atmosphere and the wipes to become overly dry.

As noted above, the dispensing partition 48 is connected to the container 20 by the port 50. The dispensing partition 48 can be connected to the port 50 by any suitable means, such as, sonic welding, heat staking, molding, adhesives, or any other suitable means that enables the dispensing partition 48 to function as described herein. In the illustrated embodiment, the dispensing partition 48 is connected to the port 50 via a generally planar sheet 56 of flexible material extending in the x- and y-directions 32, 34, and defining a horizontal plane 58 about which the dispensing partition 48 is inverted when a wipe 30 is removed from the container through the dispensing aperture 54. The sheet 56 is formed integrally with the dispensing partition 48. That is, the sheet 56 is formed from the same unitary section of material from which the dispensing partition 48 is formed. In other suitable embodiments, the dispensing partition 48 may be connected directly to the port 50, and the sheet 56 may be omitted. In yet other suitable embodiments, the dispensing partition 48 may be connected to any suitable portion of the container 20 that enables the dispensing partition 48 to function as described herein.

The dispensing aperture 54 can have any suitable size and shape that enables the dispensing partition 48 to function as described herein. In the illustrated embodiment, the dispensing aperture 54 is a continuous, elongated, "S"-shaped slit, although it is contemplated that the dispensing aperture 54 can have other shapes, such as a sinusoidal shape, or a zig-zag shape.

As described in more detail herein, the dispensing partition 48 is configured to be moved (specifically, inverted) from a first position (shown in FIG. 2), also referred to herein as a non-dispensing state, to a second position (shown in FIG. 3), also referred to herein as a dispensing state, when a wipe 30 is removed from the container 20 through the dispensing aperture 54. That is, the dispensing partition 48 is configured to move from the first position to the second position in response to a wipe 30 being removed from the container 20 through the dispensing aperture 54. The movement of the dispensing partition 48 facilitates reducing the overall size of the dispensing container 20 as compared to known dispensing containers, allows the lid top 46 to easily close, and inhibits wipes extending through the dispensing aperture 54 from being pushed back into the container 20 by the lid top 46.

The lid top 46 is hingedly connected to the lid base 44 at a hinge 60, and is moveable between an open position (shown in FIG. 1) and a closed position (shown in FIG. 2) to allow a user access to contents of the container 20, and to seal the compartment 26 when the container 20 is not in use. In the illustrated embodiment, the lid top 46 includes a male latching member 62 that engages a female latching member 64 on the lid base 44 to secure the lid top 46 is in the closed position. A biasing member (not shown) is positioned against the lid top 46 and the lid base 44 at the hinge to bias the lid top 46 towards the open position. The biasing member may be formed by a band or strip of flexible rubber, plastic, or metal, such as silicone or a metal spring. The female latching member 64 is operatively connected to an activation button 66, which is depressible in the vertical direction 36 to disengage the female latching member 64 from the male latching member 62. When the activation button 66 is depressed, the male latching member 62 disengages the female latching member 64, and the biasing member moves the lid top 46 to the open position. Although the lid assembly 24 is described with reference to a specific male/female latching system, it is contemplated that any suitable latching system may be used with the lid assembly 24 that enables the dispensing container 20 to function as described herein.

The wipes 30 can be arranged in the container in any suitable manner that provides convenient and reliable one at a time dispensing and which assists the wipes 30 in not becoming dirty and/or overly dry. In the illustrated embodiment, the wipes 30 are arranged in the container as a stack 28 of interconnected wipes which are folded in an accordion-like stacked configuration.

The individual wipes 30 can be connected together along lines of frangibility, such as lines of perforations, to ensure that a trailing wipe is in position for grasping by the user after a leading wipe is removed from the dispensing container 20. In one suitable embodiment, for example, the wipes 30 are formed by a continuous web of material which has a series of lines of frangibility extending across the width of the web. In another suitable embodiment, the wipes 30 are connected by interconnecting folds between adjacent wipes.

Suitably, the individual wipes 30 can be interfolded or continuously interconnected so that the leading and trailing edges of successive wipes in the stacked configuration will interact for "pop-up" dispensing. In such a configuration, the leading edge of a trailing wipe is loosened from the stack by the trailing edge of a leading wipe as the leading wipe is removed from the container 20 by the user.

Each wipe 30 is generally rectangular in shape and defines a pair of opposite side edges 31 (only one of which is visible in FIG. 2) and a pair of opposite end edges, referred to herein as a leading edge 33 and a trailing edge 35. In use, when a leading wipe is removed from the container 20, the leading edge 33 of a trailing wipe is typically positioned within the dispensing aperture 54 such that the leading edge 33 can be grasped by a user to facilitate removal of the wipe from the container 20.

Figure 2:
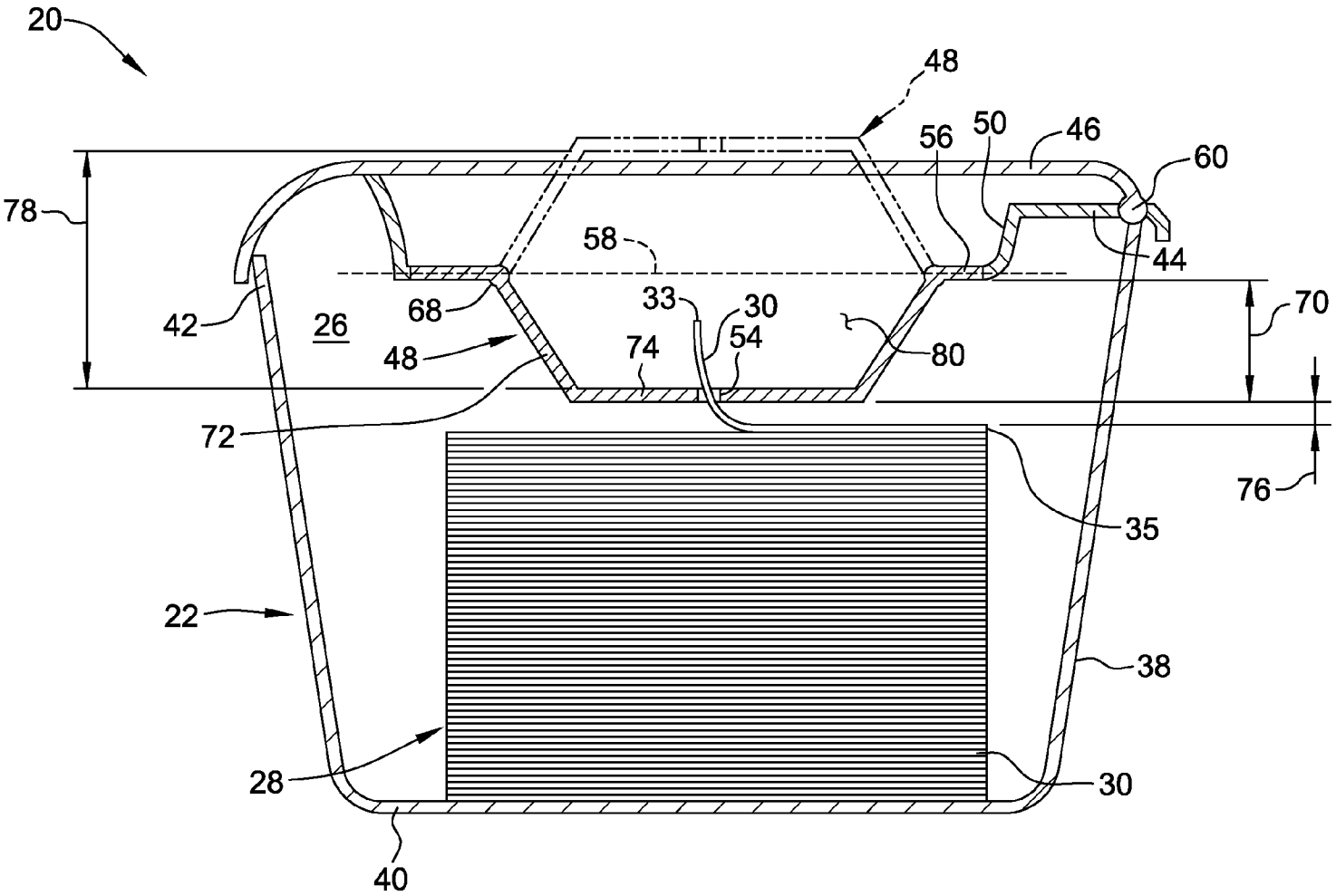
FIG. 2 is a cross-sectional view of the dispenser of FIG. 1 with the dispensing partition in a first, non-dispensing position.
Figure 3:
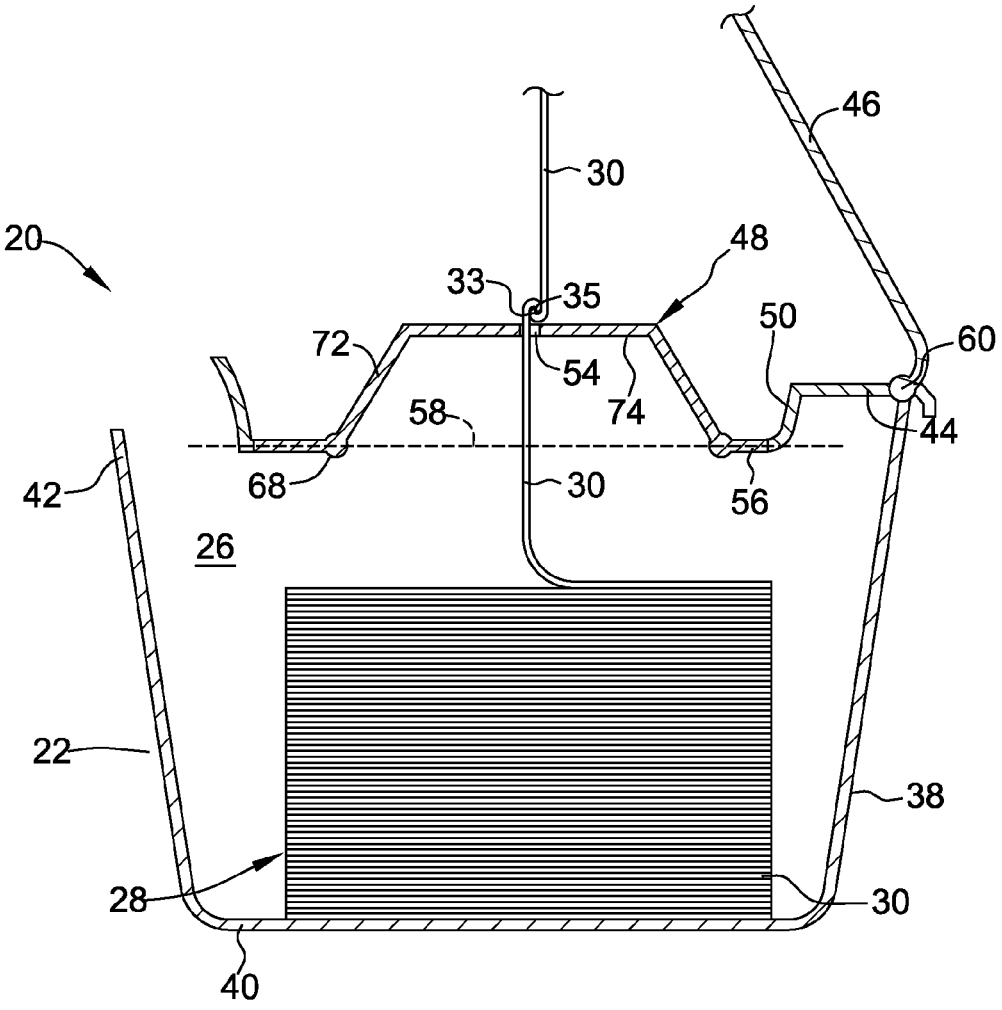
FIG. 3 a cross-sectional view of the dispenser of FIG. 1 with the dispensing partition in a second, dispensing position.

With additional reference to FIGS. 2 and 3, the dispensing partition 48 is connected to the dispensing container 20 (specifically, the sheet 56) at a hinge 68, and extends downwardly from the hinge 68 into the compartment a distance 70, also referred to herein as a depth of the dispensing partition 48. The dispensing partition 48 includes a sloped or angled sidewall 72 and a relatively planar floor 74. The sidewall 72 is connected to the hinge 68, and extends downwardly from the hinge 68 to the floor 74 of dispensing partition 48. The dispensing aperture 54 is defined along the floor 74 of the dispensing partition 48. As described herein in more detail, the dispensing partition 48 is moveable, and more specifically invertible, about the hinge 68 such that the dispensing partition is moveable between the first position in the non-dispensing state (shown in FIG. 2) and the second position when in the dispensing state (shown in FIG. 3).

In the illustrated embodiment, the hinge 68 is formed from the same section of material from which the sheet 56 and the dispensing partition 48 are formed. In other words, the hinge 68 is integrally formed with the dispensing partition 48. Further, the hinge 68 is disposed in a generally horizontal plane about which the dispensing partition 48 is invertible. In the illustrated embodiment, the plane in which the hinge 68 is disposed is the same plane as the horizontal plane 58 defined by the sheet 56. Further, in the illustrated embodiment, the hinge 68 is an annular hinge, and is connected to the entire perimeter of the dispensing partition 48 at an upper end thereof. In other suitable embodiments, the hinge 68 may be other than an annular hinge, and may be connected to only part of the perimeter of the dispensing partition 48. In one suitable embodiment, for example, the dispensing partition 48 is connected to the base 22 along opposing sides of the dispensing partition 48, forming two separate, substantially linear hinges.

The sidewall 72 and the floor 74 of the dispensing partition 48 define a generally concave shape with respect to the internal compartment 26 when the dispensing partition 48 is in the first, non-dispensing position. In the illustrated embodiment, the floor 74 is substantially planar and is oriented substantially parallel to the plane 58 defined by the sheet 56, and the sidewall 72 extends substantially linearly from the hinge 68 to the floor 74. The floor 74 and the sidewall 72 thereby define a generally frustoconical shape (i.e., a truncated cone) of the dispensing partition 48. It is contemplated that the dispensing partition 48 can have other suitable shapes, such as a hemi-spherical shape, an ellipsoidal shape, an otherwise rounded shape, or any other suitable shape that enables the dispensing partition 48 to function as described herein. In one suitable embodiment, for example, the sidewall 72 and the floor 74 are formed from a single, continuous, rounded wall, and the dispensing partition 48 has a generally ellipsoidal shape.

As noted above, the dispensing partition 48 extends downwardly from the hinge 68 into the compartment to a depth 70. More specifically, the depth 70 of the dispensing partition 48 is defined as the distance between the hinge 68 (i.e., the point or points at which the dispensing partition 48 is connected to the container 20) and the floor 74 of the dispensing partition 48. The depth 70 is sufficiently large such that when the dispensing partition 48 is in the second position (i.e., when the dispensing partition 48 is inverted about the plane within which the hinge 68 is disposed), a sufficient distance is provided between the dispensing aperture 54 and the leading edge 33 of a trailing wipe to allow the trailing wipe to properly unfold as the leading edge 33 of the trailing wipe is pulled through the dispensing aperture 54. In one suitable embodiment, for example, the depth 70 of the dispensing partition 48 is between about 0.10 inches and about 1.0 inches, more suitably between about 0.125 inches and about 0.5 inches and, even more suitably, between about 0.20 inches and about 0.30 inches.

As shown in FIG. 2, the dispensing partition 48 (specifically, the floor 74 of the dispensing partition 48) is separated from the stack 28 of wipes 30 (prior to any wipes being removed from the container 20 by the user) by a distance 76, also referred to herein as a "static" head space, when the dispensing partition 48 is in the first position. As described in more detail herein, the configuration of the dispensing partition 48 allows the static head space to be reduced as compared to conventional dispensing partitions. In one suitable embodiment, for example, the distance 76 between the dispensing partition 48 and the stack 28 of wipes 30 is less than about 0.5 inches, more suitably less than about 0.25 inches, and, even more suitably, less than about 0.0625 inches. In another suitable embodiment, the distance 76 between the dispensing partition 48 and the stack 28 of wipes 30 is substantially zero. That is, the dispensing partition 48 (specifically, the floor 74 of the dispensing partition 48) is in contact with the stack 28 of wipes 30.

FIG. 3 shows the dispensing partition 48 in the second position, also referred to herein as the dispensing state. As shown in FIG. 3, when the dispensing partition 48 is in the second position, the dispensing partition 48 is at least partially inverted from the first position. More specifically, the dispensing partition 48 is inverted about the plane in which the hinge 68 is disposed, which, in the illustrated embodiment, is the same plane as the plane 58 defined by the sheet 56. In the illustrated embodiment, the dispensing partition 48 is completely inverted about the plane in which the hinge 68 is disposed. That is, the entirety of the dispensing portion 48 moves from below the plane in the first position to above the plane in the second position. In other embodiments, the dispensing partition 48 may only be partially inverted about the plane in which the hinge 68 is disposed. That is, only a portion of the dispensing partition 48 may move from below the plane in the first position to above the plane in the second position.

Further, when the dispensing partition 48 is in the second position, the dispensing partition 48 has a generally convex shape with respect to the internal compartment 26. Although the dispensing partition 48 is shown in FIGS. 2 and 3 as being inverted approximately symmetrically about the plane in which the hinge 68 is disposed, it is contemplated that the dispensing partition 48 may by inverted non-symmetrically about the plane in which the hinge 68 is disposed. That is, the shape of the dispensing partition 48 in the first and second positions may be non-symmetric about the plane in which the hinge 68 is disposed.

The second position of the dispensing partition 48 is also shown in dashed lines in FIG. 2. As shown in FIG. 2, the dispensing partition 48 (more specifically, the floor 74 of the dispensing partition 48) is displaced by a vertical distance 78, also referred to as a "dynamic" head space, when the dispensing partition 48 is moved from the first position to the second position. The distance 78 by which the dispensing partition 48 is displaced is sufficient to provide a sufficient head space to allow a trailing wipe to properly unfold as the leading edge 33 of a trailing wipe is pulled through the dispensing aperture 54 by a leading wipe. In one suitable embodiment, for example, the distance 78 is between about 0.2 inches and about 2.0 inches, more suitably between about 0.25 inches and about 1.0 inches, and, even more suitably, between about 0.40 inches and about 0.60 inches.

The displacement of the dispensing partition 48 between the first and second positions provides a sufficient distance (or head space) between a trailing wipe and the dispensing aperture 54 when the dispensing partition 48 is in the dispensing state to allow the trailing wipe to properly unfold as the leading edge of the trailing wipe is pulled through the dispensing aperture 54. Because the dispensing partition 48 moves to provide a sufficient head space in the dispensing state, the static head space 76 between the stack 28 of wipes 30 and the dispensing aperture 54 can be reduced as compared to known dispensing containers, thereby providing a relatively small, more compact design as compared to known dispensing containers.

Referring again to FIG. 2, the dispensing partition 48 defines a storage space 80 within which the leading edge 33 of a wipe 30 is positioned when the dispensing partition 48 is in the first position. The storage space 80 is defined between the floor 74 of the dispensing partition 48 and the lid top 46. Because the dispensing partition 48 extends downwardly from the hinge 68 and into the compartment 26, the storage space 80 provides a space within which the leading edge 33 of a wipe 30 may be positioned without interfering with the operation of the lid top 46. Further, the storage space 80 inhibits the lid top 46 from pushing a wipe 30 back through the dispensing aperture 54 when the lid top 46 is closed.

In use, a user opens the dispensing container 20 by pressing or otherwise activating the activation button 66 to open the lid top 46 and gain access to the dispensing partition 48. If the dispensing container 20 has not been previously used, or if no wipe 30 projects out of the dispensing aperture 54, the user may need to reach through the dispensing aperture 54 to grab the first wipe in the stack 28 of wipes 30, and pull a leading edge 33 of a leading wipe through the dispensing aperture 54. If the user does not immediately need the wipe, it can be left in the dispensing aperture 54 partially dispensed where it can be maintained in place by the dispensing aperture 54 until the wipe is subsequently needed. The dispensing partition 48 will maintain the partially dispensed wipe 30 in place, with part of the wipe (e.g., the trailing edge 35) disposed within the internal compartment 26, and part of the wipe (e.g., the leading edge 33) disposed within the storage space 80 between the dispensing partition 48 and the lid top 46. If the user desires to immediately use the wipe, the user can pull the wipe through the dispensing aperture 54, and completely out of the container 20.

As the wipe 30 is pulled through the dispensing aperture 54, frictional forces between the wipe 30 and the dispensing partition 48 urge the dispensing partition 48 upwards, and eventually cause the dispensing partition 48 to move or invert from the first, non-dispensing position (shown in FIG. 2) to the second, dispensing position (shown in FIG. 3). As shown in FIGS. 2 and 3, the dispensing partition 48 is at least partially inverted from the first position when moved to the second position. More specifically, the dispensing partition 48 is inverted about the plane within which the hinge 68 is disposed, which is the same plane as the plane 58 defined by the sheet 56.

As noted above, the dispensing partition 48 is displaced by the distance 78 when the dispensing partition 48 is moved from the first position to the second position. The distance 78 is sufficient to provide a sufficient head space to allow a trailing wipe to properly unfold as the leading edge 33 of the trailing wipe is pulled through the dispensing aperture 54 by the leading wipe.

As the leading wipe passes through the dispensing aperture 54, the leading wipe pulls a trailing wipe through the dispensing aperture 54 such that the leading edge 33 of the trailing wipe extends through the dispensing aperture 54. Further, as the leading wipe passes through the dispensing aperture, frictional forces between the dispensing partition 48 and the leading and trailing wipes increase, and eventually cause the leading wipe and the trailing wipe to separate from one another along a line of frangibility (e.g., a line of weakness, such as a perforation). The flexible, resilient material from which the dispensing partition 48 is formed biases the dispensing partition 48 towards the first position such that the dispensing partition 48 returns to its original, non-dispensing position after the wipe has passed through the dispensing aperture 54. More specifically, when the leading wipe is separated from the trailing wipe, the dispensing partition 48 returns to its original, non-dispensing position under the biasing force provided by the flexible, resilient material.

The leading edge 33 of the trailing wipe, which is now a leading wipe, extends out of the dispensing aperture 54 and is readily accessible to be grasped by a user for subsequent dispensing. The dispensing aperture 54 maintains the position of the wipe such that the leading edge 33 of the wipe is positioned within the storage space 80 defined by the dispensing partition 48.

When the user no longer desires wipes from the dispensing container 20, the user closes the lid top 46 by rotating the lid top 46 and latching the male and female latching members 62 and 64 together. The storage space 80 defined by the dispensing partition 48 reduces the likelihood that the leading edge 33 of a wipe will block or otherwise prevent the lid top 46 from completely closing. Further, the storage space 80 inhibits the lid top from pushing the leading edge of a wipe back through the dispensing aperture 54 and into the internal compartment 26.

When introducing elements of the present invention or suitable embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A dispensing container for dispensable wipes, the dispensing container comprising:

a base at least partially defining an internal compartment for storing the wipes; and a dispensing partition connected to the base, the dispensing partition comprising a flexible material having an aperture defined therein through which the wipes are individually removable, the dispensing partition configured to move from a first position to a second position when one of the wipes is removed from the container through the aperture, wherein the dispensing partition is biased towards the first position and is fully inverted from the first position when in the second position such that the second position of the dispensing partition is a mirror image of the first position, the dispensing partition extending downward a first distance when in the first position and extending upward a second distance when in the second position, the first distance being equal to the second distance.

2. The dispensing container set forth in claim 1, wherein the dispensing partition is connected to the base at a hinge, the dispensing partition configured to move with respect to the hinge when a wipe is removed from the container through the aperture.

3. The dispensing container set forth in claim 2, wherein the hinge is disposed within a plane, the dispensing partition invertible about the plane when a wipe is removed from the container through the aperture.

4. The dispensing container set forth in claim 2, wherein the dispensing partition extends a distance downward from the hinge into the compartment, the distance being between about 0.10 inches and about 1.0 inches.

5. The dispensing container set forth in claim 1, wherein the dispensing partition is further configured to return to the first position after a wipe being removed has passed through the aperture.

6. The dispensing container set forth in claim 1, further comprising a stack of interconnected wipes disposed within the internal compartment.

7. The dispensing container set forth in claim 6, wherein each wipe includes a leading edge and a trailing edge, the leading edge of one wipe extending through the aperture and into a storage space defined by the dispensing partition.

8. The dispensing container set forth in claim 1, wherein the dispensing partition has a concave shape with respect to the internal compartment when in the first position, and a convex shape with respect to the internal compartment when in the second position.

9. A dispensing partition for use with a dispensing container for storing and dispensing dispensable wipes, the dispensing partition comprising:

a flexible material having an aperture defined therein through which the wipes are individually removable, the dispensing partition configured to move from a first position to a second position when one of the wipes is removed from the container through the aperture, wherein the dispensing partition is biased towards the first position and is fully inverted from the first position when in the second position such that the second position of the dispensing partition is a mirror image of the first position, the dispensing partition extending downward a first distance when in the first position and extending upward a second distance when in the second position, the first distance being equal to the second distance.

10. The dispensing partition set forth in claim 9, wherein the dispensing partition comprises a thermoplastic elastomer.

11. The dispensing partition set forth in claim 9, wherein the dispensing partition is connectable to the base by a hinge, the dispensing partition configured to invert about the hinge when a wipe is removed from the container through the aperture.

12. The dispensing partition set forth in claim 9, wherein the dispensing partition is further configured to return to the first position after a wipe being removed has passed through the aperture.

13. The dispensing partition set forth in claim 9, wherein the dispensing partition has a concave shape in the first position, and a convex shape in the second position.

14. The dispensing partition set forth in claim 9, wherein the dispensing partition comprises a floor and a sidewall extending outward from the floor, the aperture defined within the floor of the dispensing partition.

15. The dispensing partition set forth in claim 14, wherein the floor is displaced by a distance of at least about 0.20 inches when the dispensing partition moves from the first position to the second position.

16. The dispensing partition set forth in claim 14, wherein the floor is displaced by a distance of between about 0.25 inches and about 1.0 inches when the dispensing partition moves from the first position to the second position.

17. The dispensing partition set forth in claim 14, wherein the floor and the sidewall are constructed from a unitary piece of material.

18. The dispensing partition set forth in claim 9, wherein the aperture comprises an elongated slit.

19. A dispensing container for dispensable wipes, the dispensing container comprising:

a base at least partially defining an internal compartment for storing the wipes; and a dispensing partition comprising a flexible material having an aperture defined therein through which the wipes are individually removable, the dispensing partition connected to the base at a hinge, the dispensing partition extending downwardly into the compartment from a plane within which the hinge is disposed, wherein the dispensing partition is invertible about the plane from a first position to a second position when a wipe is removed from the container through the aperture such that the second position of the dispensing partition is a mirror image of the first position, the dispensing partition extending downward a first distance when in the first position and extending upward a second distance when in the second position, the first distance being equal to the second distance.

20. The dispensing container set forth in claim 19, wherein the dispensing partition is displaced by a distance of at least about 0.20 inches when moved from the first position to the second position.

21. The dispensing container set forth in claim 20, wherein the dispensing partition is displaced by a distance of between about 0.25 inches and about 1.0 inches when moved from the first position to the second position.

* * * * *